United States Patent [19]

Berenson

[11] Patent Number: 4,585,922

[45] Date of Patent: Apr. 29, 1986

[54] BLANKET WIRE CORD CONNECTOR MODULE

[75] Inventor: Allen V. Berenson, Chicago, Ill.

[73] Assignee: Sunbeam Corporation, Oak Brook, Ill.

[21] Appl. No.: 678,310

[22] Filed: Dec. 5, 1984

[51] Int. Cl.[4] ..... H05B 1/00

[52] U.S. Cl. ..... 219/212; 174/135; 339/101; 339/103 R

[58] Field of Search ..... 219/212, 211, 528, 529, 219/504, 505, 548, 549, 541; 174/135; 339/101, 103 R, 103 M

[56] References Cited

U.S. PATENT DOCUMENTS

| | | | |
|---|---|---|---|
| 2,317,189 | 4/1943 | Heiser | 219/541 |
| 2,696,549 | 12/1954 | Sturtevant | 219/212 |
| 2,710,949 | 6/1955 | Happe | 339/101 |
| 3,108,175 | 10/1963 | Zartman | 219/212 |
| 3,265,864 | 8/1966 | Levinson | 219/529 |

*Primary Examiner*—Clarence L. Albritton
*Assistant Examiner*—Teresa J. Walberg
*Attorney, Agent, or Firm*—Neil M. Rose; Clifford A. Dean

[57] ABSTRACT

An electric blanket having a terminal block for connecting the tortuous flexible heating element of the blanket to a detachable power cord with the terminal block being mounted by means of flexible tabs positioned on strain relief members, the tabs being sewn or stitched to the blanket shell with a portion of the terminal block extending through a slot in the blanket shell.

18 Claims, 6 Drawing Figures

BLANKET WIRE CORD CONNECTOR MODULE

BACKGROUND OF THE INVENTION

The present invention relates to electric blankets and more particularly to means for interconnecting the flexible heating element disposed in the blanket shell to an outside source of electric power. Although there are various types of electric blanket controls involving temperature sensing means which may be either within the blanket itself or in a control box located remote from the blanket, there is always a need for a detachable connection between the electrical wiring or harness contained in the blanket shell and the external power or control cable. This cable and any associated controls are conventionally made detachable from the blanket so that the blanket may be washed or cleaned without immersing the cable or the controls.

It has, in the past, been common practice to provide sewn in pockets or compartments within which these terminal connections may be positioned. In addition, in some instances, the connector for the blanket merely extends outwardly through an opening in the blanket with some type of strain relief being associated with the cord. It has been known in the prior art to mold a terminal connector onto the ends of the heating element and utilize a flexible tab molded integrally with the connector to sew it directly to the blanket. Prior art cord connectors have been generally unsatisfactory or have been unacceptably high in cost and difficult to assemble to the blanket shell. Accordingly, it would be desirable to provide an electric blanket having a cord connection which would overcome the problems and the cost objections associated with the prior art devices.

SUMMARY OF THE INVENTION

To provide an electric blanket with an improved cord connection, the present invention provides a terminal block or housing having a pair of rigid members in which the heating element ends are connected to terminal pins and which includes strain relief members having flat assembly tabs which are made of a flexible vinyl plastic so that the assembly tabs may be sewn directly to the blanket shell. The terminal block or housing is captured between a slot formed in the blanket shell and the sewn connection between the assembly tabs and the shell. The connection provides a protected enclosure within which the connections between the ends of the heating element and the terminal pins are made and a suitable strain relief which prevents any force applied to the power cord from displacing the heating element disposed within the blanket shell. The subject terminal block and connector is inexpensive to manufacture and easy to assemble to the blanket shell.

Accordingly, it is an object of the present invention to provide an improved terminal block or connector to interconnect a blanket heating element with a detachable power cord.

It is a further object of the present invention to provide an improved terminal block for an electric blanket wherein the terminal block may be assembled to the blanket shell by a simple stitching operation.

Still another object of the present invention is to provide a simplified terminal block having rigid plastic parts to support the connections between the heating elements and the terminal pins for the power cord and flexible strain relief members including assembly tabs which may be sewn to the blanket shell.

Further objects and advantages will become apparent as the following description proceeds and the features of novelty which characterize the invention will be pointed out in the claims annexed to and forming a part of the specification.

DESCRIPTION OF THE PREFERRED EMBODIMENT

Figure 1:
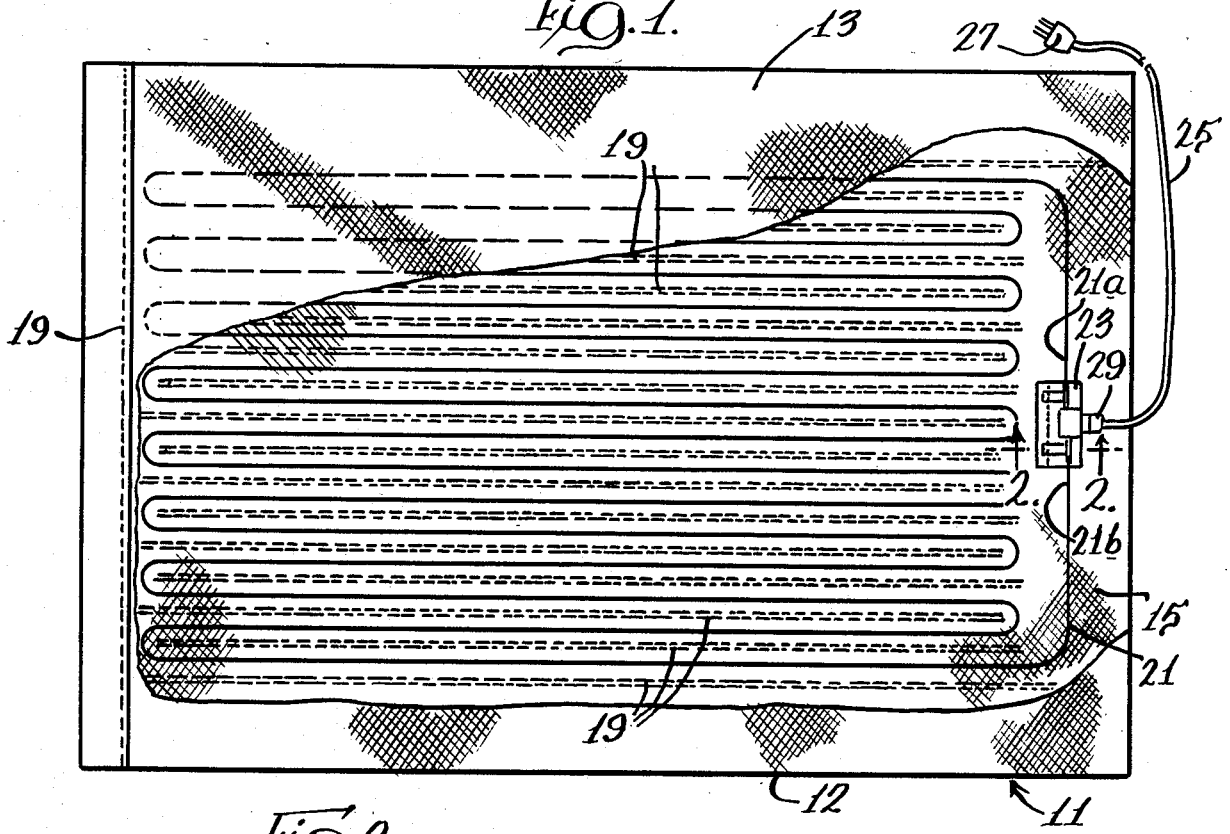
FIG. 1 is a plan view of a typical electric blanket having a portion of the upper layer of the blanket shell cut away to expose the heating element for the blanket and utilizing our improved terminal block and cord connector.

Referring to FIG. 1, there is shown an automatic electric blanket which is designated generally by reference numeral 11. The blanket itself is conventional in that it includes a blanket shell 12 having two coextensive fabric layers, an upper layer 13 and a lower layer 15 which together form the blanket shell 12. The layers of the blanket shell 12 are secured together in strips as shown by the dotted lines 19 to form a number of parallel passageways through which a heating element 21 extends. The heating element 21 extends back and forth through the passageways defined by the strips 19 so that heat is delivered substantially uniformly to the entire surface of the blanket 11.

The blanket 11 is further provided with a terminal block 23 into which the ends **21*a* and 21*b* of the heating element 21 extend. In order to interconnect the heating element 21 to a suitable source of power, there is provided a power cord 25 which includes a plug 27 adapted for insertion into an electrical power receptacle and a plug portion 29 which interconnects the cord 25 to the terminal block 23**.

Figure 5:
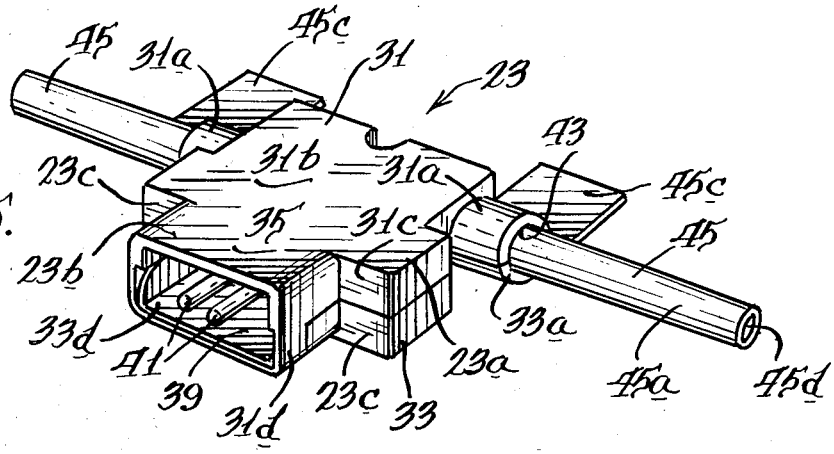
FIG. 5 is a perspective view of the terminal block showing the strain reliefs associated therewith.
Figure 6:
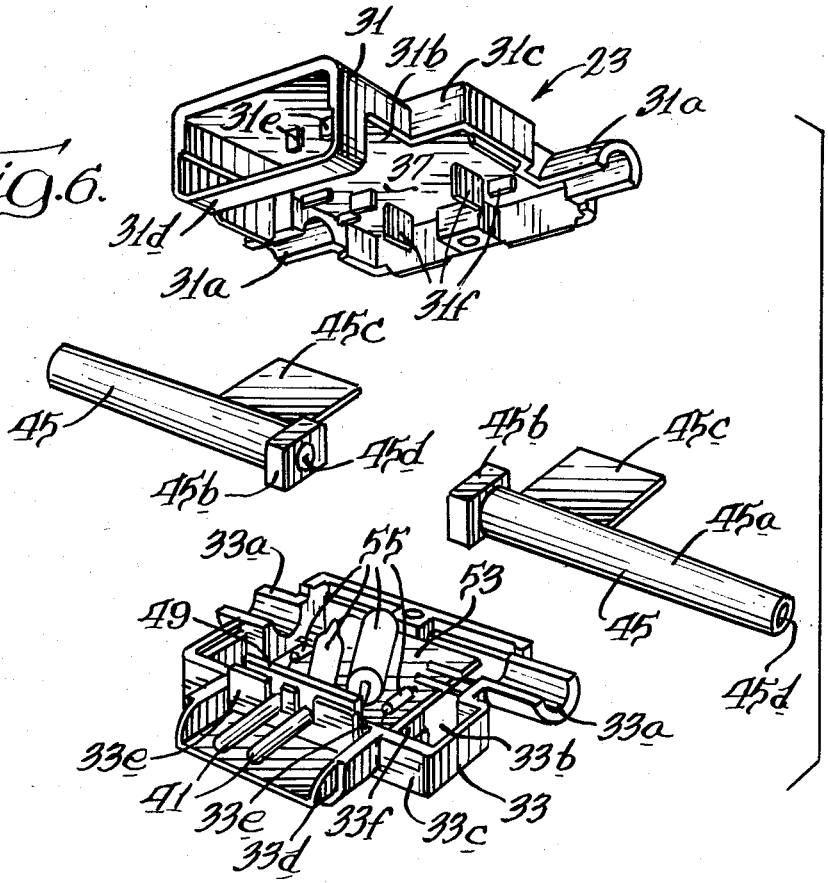
FIG. 6 is an exploded perspective view of the terminal block showing the housing members disassembled from each other and the strain reliefs separated from the housing portion.

Referring to FIGS. 5 and 6, the terminal block 23 is shown in enlarged scale and in perspective. The terminal block 23 includes an upper housing member 31 and a lower housing member 33. The housing members 31 and 33 together form housing 35 which defines an enclosure 37 into which there are three openings, one of which is an opening 39 within which a pair of male terminal members 41 are supported. The opening 39 is actually defined by a passageway which is of suitable size to guide and receive the plug connector 29 on the cord 25. The plug connector 29 is provided with conventional female terminal connectors which receive the terminal pins 41 when the plug connector 29 is inserted into the opening 39.

The terminal block 23 has a substantially rectangular body portion **23*a* from which a lateral extension 23*b*** projects to form the opening or passageway 39 within which the plug connector 29 is received. Adjacent the extension 23*b*, the terminal block 23 is formed with shoulder portions 23*c* the function of which will be explained further below.

In order to control the flexure of the heating element wire as it enters the terminal block 23 and to form a strain relief for the connections in the terminal block, there are provided two strain reliefs 45, one for each end of the heating element 21. Positioned on the portion of the terminal block 23 remote from the opening 39 are a pair of openings 43 (one of which is shown in FIG. 5) for the purpose of receiving the strain reliefs 45. The strain reliefs 45 are each formed with cylindrical shank portions 45*a*, body portions 45*b* and tabs 45*c*. Passageways 45*d* are provided in both of the strain reliefs so that the ends 21*a* and 21*b* of the heating element 21 may extend into the terminal block 23.

Each of the housing members 31 and 33 are formed with semi-cylindrical projections 31*a* and 33*a* respectively which cooperate with each other to form the openings 43 which are adapted to receive the strain reliefs 45. When the strain reliefs 45 are in assembled position on the housing 35, body portions 45*b* are trapped within the enclosure 37 while the shank portions 45*a* are clamped at their innermost ends between the semi-cylindrical projections 31*a* and 33*a*. As shown best in FIG. 5, in assembled position in the housing 35, the strain reliefs 45 are clamped rigidly with the outer ends of the shank portions 45*a* exposed and the tabs 45*c* extending beyond the semi-cylindrical projections 31*a* and 33*a*. It should be noted that the strain reliefs 45 are made of a vinyl plastic material having a durometer of about 69. This flexibility in the shank portion 45*a* and the tab 45*c* provides the desired controlled flexure of the heating element ends and strain relief function with respect to the heating element 21 and accomplishes the assembly functions to be described below.

Each of the housing members 31 and 33 includes a flat body portion 31*b* and 33*b* respectively with an upstanding peripheral wall 31*c* and 33*c*. The peripheral walls 31*c* and 33*c* abut to form the enclosure 37 with the openings 39 and 43. In order to retain the housing members 31 and 33 in their assembled relation, the upper housing member 31 is formed with a U-shaped wall member 31*d* under which a projecting portion 33*d* on the lower housing member 33 is adapted to extend. This engagement of the projection 33*d* under the U-shaped wall 31*d* locks one side of the housing 35 together. At the other edge of the housing there is provided an assembly screw 47 as shown in FIG. 3 which extends through the upper housing member 31 into threaded engagement with the lower housing member 33 to clamp the two housing members together.

The terminal pins 41 are supported in parallel spaced relationship on an insulating fiberboard plate 49 as best shown in FIG. 6. The plate 49 is held in an upright position at one end of the opening 39 by means of two upstanding walls 33*e* which engage the opposite face thereof. The upper housing member 31 is formed with two projections 31*e* which extend into slots in one of the walls 33*e* to protect and shield the plate 49.

Mounted within the enclosure 37 formed by the housing 35 is a circuit board 53 which is positioned and clamped between a plurality of walls 31*f* and 33*f* formed integrally with the housing members 31 and 33 respectively. The terminal board 53 may support nothing more than the connectors which interconnect the pins 41 with the heating element ends 21*a* and 21*b* or there may be additional circuit components 55 as shown in the preferred embodiment disclosed herein. The type of circuit elements which may be mounted on the board 53 are described in detail in U.S. Pat. No. 4,436,986, to Carlson which relates to an electric blanket having a positive temperature coefficient heating element and a control module therefor.

Figure 2:
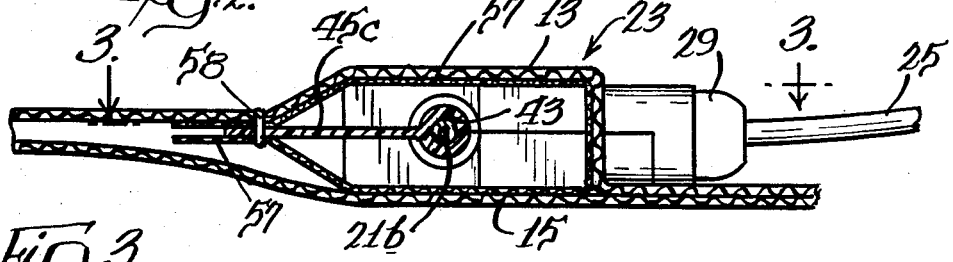
FIG. 2 is a greatly enlarged sectional view of the terminal block taken substantially on line 2—2 of FIG. 1.
Figure 3:
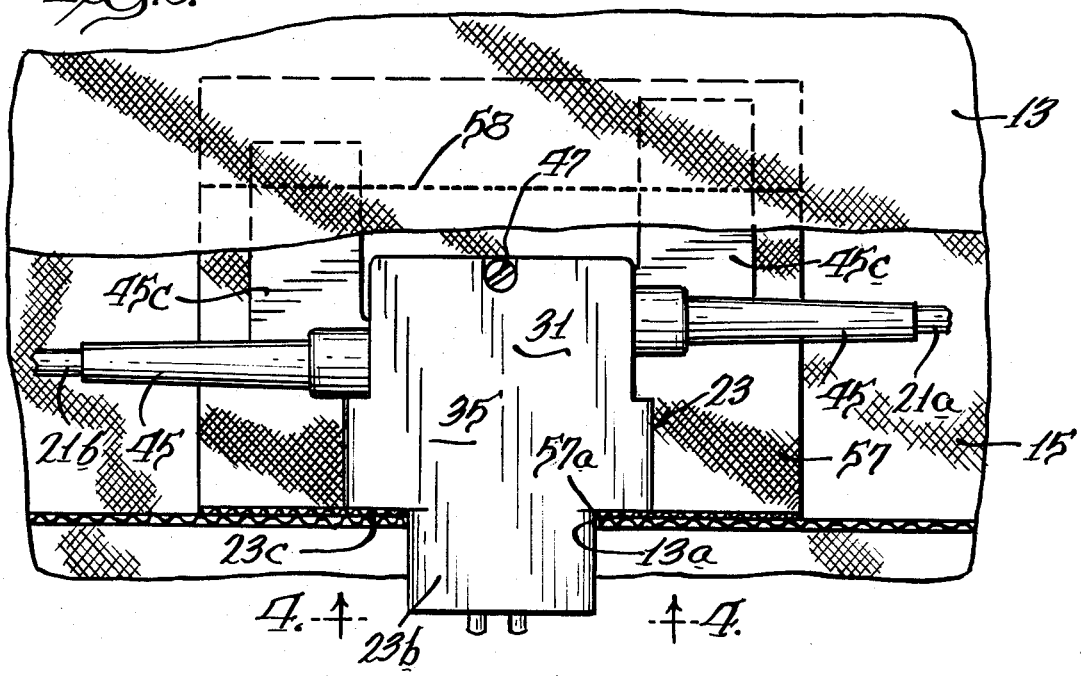
FIG. 3 is a sectional view of the terminal block with the cord connector removed taken substantially on line 3—3 of FIG. 2.
Figure 4:
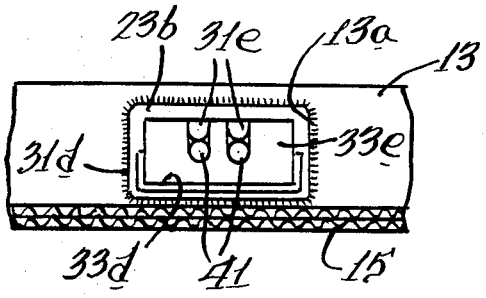
FIG. 4 is a fragmentary elevational view partly in section taken substantially on line 4—4 of FIG. 3.

The terminal block 23 is secured only to the upper fabric layer 13 as best shown in FIGS. 2 and 3. This would actually be the lower fabric layer as the blanket would be placed on the bed since the cord connector would normally be positioned on the underside of the blanket to keep it hidden from view. Folded around the terminal block 23 is a layer of reinforcing fabric 57 which has formed at its folded edge an opening or slot 57*a* through which the extension 23*b* on the housing 35 protrudes. Aligned with the slot 57*a* is another slot 13*a* formed in the upper fabric layer 13. The aligned slots 57*a* in the reinforcing fabric 57 and 13*a* in the upper fabric layer 13 are stitched together with a buttonhole type stitch to prevent raveling of the material and provide a strong connection between both pieces of fabric. The reinforcing fabric 57 is sandwiched on either side of the tabs 45*c* and a line of stitching 58 is applied through the reinforcing fabric 57, the tabs 45*c* which are less than 0.06 inches in thickness and the upper fabric layer 13 as best shown in FIGS. 2 and 3.

This arrangement secures the terminal block 23 with respect to the blanket 11 by virtue of the fact that the terminal block 23 is restrained from movement at the edge where portion 23*b* extends through the slots 57*a* and 13*a* and the other side of the terminal block 23 is retrained by the stitching 58 which secures the tabs 45*c* to the reinforcing fabric 57 and the upper fabric layer 13.

Looking at the view of the connector as shown in FIG. 3, we note that it can not move downwardly since the shoulders 23*c* on the terminal block 23 engage the portion of the reinforcing fabric immediately adjacent the slot 57*a*. This engagement maintains the snug relationship of the fabric envelope within which the terminal block 23 is disposed. The stitching 58 through the tabs 45*c* and the engagement of the projection 23*b* with the slots in the fabric prevent displacement in any direction with respect to the fabric layer 13. It should be understood that the fabric layers 13 and 15 are made of loosely woven yarn such as wool or a synthetic or a combination of the two as is conventional in electric or non-electric blankets. Such a fabric would not provide sufficient support for the sewn connection to the terminal block end, and therefore, the reinforcing fabric 57 is used. The reinforcing fabric is made of a much tighter weave than the blanket shell and is more resistant to wear and deformation.

The novel terminal block 23 described herein and the manner of assembling it to the blanket layers 13 and 15 provide significant advantages over anything heretofore used in the art. The rigid plastic enclosure for the terminal connections with the two flexible cord guides and strain reliefs provide a simple and effective means for securing the terminal block to the blanket by simply stitching the layers of reinforcing fabric and the flexible tabs to one layer of the blanket shell. In addition, the housing 23 with its integral wall portions to support the terminal pins 41 and to provide the interconnection between the portions of the housing members 31 and 33 forming the projection 23*b* make it possible to secure the housing members together with a single screw. Further the strain reliefs 45 are effectively retained in assembled relationship to the plug connector by the simple clamping action of the housing members.

What is claimed as new and desired to be secured by Letters Patent of the United States is:

1. An electric blanket comprising a pair of coextensive layers of fabric having strips along which said layers are secured to form a continuous channel in which an elongated heating cable is disposed, said cable having two ends which are connected in a terminal block to a two conductor power cord, said terminal block including a pair of housing members which form an enclosure in which said cable ends are connected to said power cord, a pair of flexible strain relief members each having an enlarged body portion, a sleeve portion and a flat assembly tab portion, said body portions being captured in opposed recesses in said housing members with said sleeve and tab portions extending outside of said enclosure, said terminal block being positioned in a slot in one of said layers with said sleeve and assembly portions being between said layers and said power cord being outside of said blanket layers, said tab portions being sewn to said blanket layers.

2. The combination of claim 1 wherein said terminal block has a body portion and an extension portion extending from one side wall thereof, said extension portion being positioned in said slot with said body portion engaging a portion of said one layer defining said slot, said body portion being too large to fit into said slot, said sewn connection between said tab portions and said blanket and engagement between said terminal block and said portion of said one layer defining said slot restricting relative movement between said block and said fabric.

3. The combination of claim 2 including a flexible support member wrapped around said terminal block and sewn to said tab portions and to said one layer defining said slot.

4. The combination of claim 3 wherein said support member comprises a folded piece of fabric which is formed with a slot at the fold, said support member being sewn to said one layer continuously around said slot, the support member having overlapping edges remote from said fold, said edges sandwiching said tab portions and being sewn to said one layer along with said tab portions.

5. In an electric blanket, the combination comprising a pair of housing members formed of a rigid insulating material which fit together to form a connector housing providing an enclosure within which a blanket heating element and a power cord are adapted to be connected, said housing members defining a first and a second opening to said enclosure, a pair of terminal pins for plug connection to said power cord mounted in said first opening, at least one heating element strain relief having an elongated cylindrical shank portion, an enlarged retaining portion and an assembly tab extending laterally from said shank portion, said strain relief being clamped in said second opening between said housing members in said second opening with said retaining portion within said enclosure and said tab outside of said enclosure, a blanket shell made of two layers of fabric having said heating element disposed therein, one end of said element extending through said strain relief into said enclosure formed by said housing members, said tab being sewn to said blanket shell to secure said connector housing thereto.

6. The combination of claim 5 including a connector board clamped within said enclosure between opposed portions of said housing members, a terminal board mounted in said enclosure and supporting said terminal pins, said heating element being connected to said terminal board and to said terminal pins.

7. The combination of claim 5 wherein one of said housing members is formed with a U-shaped wall which defines an entrance to said first opening, the other one of said housing members including a laterally extending channel portion which extends within and engages said U-shaped portion to retain said housing members assembled on a side of said housing adjacent said first opening.

8. The combination of claim 5 wherein said blanket shell includes two layers of fabric secured together along spaced lines to form between the layers of fabric channels in which said heating element is disposed, said heating element having two ends which extend into said enclosure through two of said strain reliefs, each strain relief having said tab secured to said blanket by stitching through said tabs and one of said layers, a portion of said housing defining said first opening extending through an opening in said one of said fabric layers to provide access to said terminal pins for a power cord connection.

9. The combination of claim 8 including a flexible support layer which envelopes said housing and said assembly tabs on said strain reliefs, said support layer being stitched to said one fabric layer around said opening in said one fabric layer, said support layer being stitched to said tabs and said one fabric layer.

10. The combination of claim 5 wherein said strain relief is formed of a flexible material and said tab is less than 0.06 inches in thickness.

11. The combination of claim 5 wherein said shank portion is cylindrical having a diameter and said retaining portion extends radially outwardly of said shank portions said second opening being substantially equal in diameter to said shank portion, walls on said housing members engaging said retaining portion to secure said strain relief relative to said housing.

12. In an electric blanket the combination comprising a blanket shell being formed of two layers of fabric secured together to form a passageway within which an elongated heating element is disposed, a connector for interconnecting ends of said heating element to a power cord, said connector being disposed between said layers and having a portion extending through an opening in one of said layers to provide engagement with a power cord, said connector having a rigid housing of insulating material, a pair of strain reliefs formed of a flexible insulating material and being fixed to said housing, each strain relief having a flat tab which is stitched to said one layer of fabric, said ends of said heating element extending into said housing through said strain reliefs and being connected to terminal pins, said extending portion of said housing being formed with an opening to receive a detachable plug connector, said terminal pins being mounted in said housing in said opening for engagement with a plug connector.

13. The combination of claim 12 wherein said housing is formed by first and second housing members which are each formed with peripheral side walls abutting to form an enclosure, interengaging wall portions on one edge of said housing securing said members together, a separate assembly means securing the edge of said housing remote from said one edge.

14. The combination of claim 13 wherein said interengaging wall portions comprise a wall on said first housing member defining a mouth of said opening for receiving said plug connector, said second housing member having a channel shaped portion which extends within said mouth of said opening.

15. The combination of claim 12 including a flexible support member comprising a folded piece of fabric being stitched at the fold to said one layer of said shell around the opening formed therein and having a corresponding opening in said support member, said support member having overlapping edges which straddle said tabs, the layer of said support member and said tabs being stitched to said one layer of said shell.

16. The combination of claim 15 wherein said tabs extend from said housing on a side remote from said plug receiving opening, said tabs preventing displacement of said housing with respect to said one layer of said shell to maintain said housing portion protruding through said opening in said one layer of said shell.

17. The combination of claim 12 wherein said housing is formed by first and second housing members which have generally flat portions formed with peripheral side walls, said side walls abutting to form an enclosure and being interrupted to form first, second and third openings into said enclosure, said first and second openings being on opposite sides of said housing and receiving said strain reliefs, said third opening defined by a passageway within which said terminal pins are mounted.

18. The combination of claim 17 wherein said housing portion defining said passageway is narrower than the overall dimensions of said housing and extends through said opening in said one layer of said shell, the housing being too large to pass through said last mentioned opening.

* * * * *